US010361029B2

(12) United States Patent
Xu et al.

(10) Patent No.: US 10,361,029 B2
(45) Date of Patent: Jul. 23, 2019

(54) PAINT IMMERSING PROCESS FOR INSULATING PAPER

(71) Applicant: Haihong Electric Co., Ltd., Kaiping (CN)

(72) Inventors: Kaixuan Xu, Kaiping (CN); Xianqing Guo, Kaiping (CN); Qingning Liang, Kaiping (CN); Danju Song, Kaiping (CN)

(73) Assignee: Haihong Electric Co., Ltd, Kaiping (CN)

( * ) Notice: Subject to any disclaimer, the term of this patent is extended or adjusted under 35 U.S.C. 154(b) by 68 days.

(21) Appl. No.: 14/583,074

(22) Filed: Dec. 24, 2014

(65) Prior Publication Data

US 2016/0024719 A1 Jan. 28, 2016

(30) Foreign Application Priority Data

Jul. 25, 2014 (CN) ..... 2014 1 0357994

(51) Int. Cl.

| | |
|---|---|
| ***B05D 1/18*** | (2006.01) |
| ***B05D 3/02*** | (2006.01) |
| ***B05D 5/12*** | (2006.01) |
| ***H01F 27/32*** | (2006.01) |
| ***H01F 41/00*** | (2006.01) |
| ***H01F 41/32*** | (2006.01) |
| ***D21H 17/52*** | (2006.01) |
| ***D21H 17/55*** | (2006.01) |
| ***D21H 19/16*** | (2006.01) |
| ***D21H 19/24*** | (2006.01) |
| ***D21H 19/30*** | (2006.01) |

(52) U.S. Cl.

CPC ..... *H01F 41/32* (2013.01); *B05D 1/18* (2013.01); *B05D 3/0254* (2013.01); *B05D 5/12* (2013.01); *D21H 17/52* (2013.01); *D21H 17/55* (2013.01); *D21H 19/16* (2013.01); *D21H 19/24* (2013.01); *D21H 19/30* (2013.01); *H01F 27/323* (2013.01); *H01F 27/324* (2013.01); *H01F 27/325* (2013.01); *H01F 41/005* (2013.01); *B05D 2252/00* (2013.01); *B05D 2252/10* (2013.01); *B05D 2401/20* (2013.01); *B05D 2401/30* (2013.01); *B05D 2401/31* (2013.01); *B05D 2504/00* (2013.01)

(58) Field of Classification Search

CPC ..... D21H 19/10; D21H 19/12; D21H 19/14; D21H 19/16; D21H 19/20; D21H 19/72; H01F 27/323; H01F 27/324; H01F 27/325; H01F 41/005; H01F 41/32; B05D 1/18; B05D 3/0254; B05D 5/12; B05D 2252/00; B05D 2252/10; B05D 2401/20; B05D 2401/30; B05D 2401/31; B05D 2504/00

USPC ..... 427/544, 180, 386, 407.1, 430.1

See application file for complete search history.

(56) References Cited

U.S. PATENT DOCUMENTS

| | | | | | |
|---|---|---|---|---|---|
| 3,083,119 | A * | 3/1963 | Flowers | D21H 19/24 | 428/413 |
| 3,237,136 | A * | 2/1966 | Ford | H01F 27/322 | 156/184 |
| 3,246,271 | A * | 4/1966 | Ford | H01B 3/30 | 156/291 |
| 3,294,618 | A * | 12/1966 | Busche | D21F 11/08 | 162/104 |
| 3,814,622 | A * | 6/1974 | Isshiki et al. | D06M 15/31 | 427/354 |
| 3,832,324 | A * | 8/1974 | Parkinson | C03C 17/326 | 523/403 |
| 3,974,302 | A * | 8/1976 | Croop | B05D 1/045 | 29/605 |
| 4,095,557 | A * | 6/1978 | Croop | B05B 15/04 | 118/301 |
| 4,160,178 | A * | 7/1979 | Smith | H01B 3/40 | 174/120 SR |
| 4,268,810 | A * | 5/1981 | Iwasa | H01F 41/122 | 264/103 |
| 4,269,894 | A * | 5/1981 | Sakai | H01B 3/46 | 156/329 |

(Continued)

FOREIGN PATENT DOCUMENTS

| | | | |
|---|---|---|---|
| CN | 101847505 A | * | 9/2010 |
| CN | 103540238 A | * | 1/2014 |
| JP | 01-129735 | * | 5/1989 |

OTHER PUBLICATIONS

Wpix and japio abstracts of JP 01-129735, May 1989.*
Translation of JP 01-129735, May 1989.*

*Primary Examiner* — William P Fletcher, III

(74) *Attorney, Agent, or Firm* — Loginov & Associates, PLLC; William A. Loginov

(57) ABSTRACT

The invention provides a paint immersing process for insulating paper, comprising the following steps: step 1, adding insulating paint in a container to blend paint; step 2, drying a base band of the insulating paper; step 3, entirely immersing the processed base band of the insulating paper into the insulating paint; or spraying the insulating paint onto the base band to cover the surface thereof; and step 4, taking out the base band to dry at controlled temperature till solidifying the insulating paint and the base band of the insulating paper. The paint immersing process is simple and practical to operate. The base band can directly cover a conductor as an insulator. As the insulating paint has a certain adhesive property, the structure of conductor with the insulating paper becomes more stable. After the conductor is wound into a coil, free of another immersing process, simplifying production.

3 Claims, No Drawings

(56) References Cited

U.S. PATENT DOCUMENTS

| | | | | | |
|---|---|---|---|---|---|
| 4,752,641 | A * | 6/1988 | Koyama | C08F 222/40 | 526/261 |
| 4,997,717 | A * | 3/1991 | Rembold | B24D 3/344 | 427/203 |
| 5,061,554 | A * | 10/1991 | Hjortsberg | C08K 3/22 | 174/110 N |
| 5,314,984 | A * | 5/1994 | Markovitz | C08F 267/10 | 525/486 |
| 5,656,350 | A * | 8/1997 | Koyama | C08G 59/063 | 428/413 |
| 2006/0127687 | A1* | 6/2006 | Yamaguchi | C09K 19/3809 | 428/474.4 |
| 2012/0128988 | A1* | 5/2012 | Yokura | B32B 5/26 | 428/419 |
| 2014/0178693 | A1* | 6/2014 | Zhang | H01B 3/40 | 428/413 |
| 2014/0183989 | A1* | 7/2014 | Lenschow | H02K 3/325 | 310/54 |

* cited by examiner

PAINT IMMERSING PROCESS FOR INSULATING PAPER

FIELD OF THE INVENTION

The invention relates to a paint immersing technology, in particular, to a paint immersing process for insulating paper.

BACKGROUND OF THE INVENTION

Currently, the surface of the existing insulating paper is not attached with any insulating paint, so that after covering a conductor, the insulating paper becomes damp in the process of winding a transformer coil, which results in reduction of the electrical performance. Therefore, the insulating paper is dried after winding the coil, and then, the coil is immersed into the insulating paint covering the surface of the insulating paper after drying in order to prevent the insulating paper from becoming damp, so as to ensure the electric performance is not reduced. But if relatively more numbers of layers of insulating paper cover the conductor, it is not close enough between layers and the insulating paint fails to completely immerse into each layer of insulating paper.

SUMMARY OF THE INVENTION

To solve above technical problems, the invention provides a paint immersing process for insulating paper. The insulating paper is covered with insulating paint through the paint immersing process and can be directly used for covering a conductor to ensure the insulating property of the conductor. The process is easy to operate and effective to improve efficiency.

To achieve the above-mentioned objectives, the invention adopts the technical scheme as follows:

A paint immersing process for insulating paper comprises the following steps:

Step 1, adding insulating paint in a container to blend paint;

Step 2, drying a base band of the insulating paper;

Step 3, entirely immersing the processed base band of the insulating paper into the insulating paint; or spraying the insulating paint onto the base band of the insulating paper to cover the surface thereof; and Step 4, taking out the base band of the insulating paper to dry at controlled temperature till solidifying the insulating paint and the base band of the insulating paper.

In the immersing process, if the insulating paint is operated in a form of spraying, spray at least once in step 3.

In the immersing process, the insulating paint is selected from solvent-free epoxy paint or polyamide paint.

The invention has the beneficial effects that: the paint immersing process is simple to operate and useful. After the paint immersing process, the insulating paper is combined with the insulating paint. The insulating paint is uniformly immersed in the inner layer and the surface of the insulating paper, so that the insulativity is good. The processed insulating paper can be directly used for covering the conductor as an insulator. As the insulating paint has a certain adhesive property, the structure of conductor with the insulating paper becomes more stable. After the conductor is wound into a coil, no need for another paint immersing process, so the production process is simplified.

DETAILED DESCRIPTION

The invention provides a paint immersing process for insulating paper comprises the following steps:

Step 1, adding insulating paint in a container to blend paint;

Step 2, drying a base band of the insulating paper;

Step 3, entirely immersing the processed base band of the insulating paper into the insulating paint; or spraying the insulating paint onto the base band of the insulating paper to cover the surface thereof; and Step 4, taking out the base band of the insulating paper to dry at controlled temperature till solidifying the insulating paint and the base band of the insulating paper.

In the paint immersing process, if the insulating paint is operated in a form of spraying, spray at least once in step 3, so the paint immersing effect of the base band of the insulating paper is better. The base band of the insulating paper can be made of different insulating materials as required and its length, width and thickness are changed according to different conductors to be covered and wound. The insulating paint can be made of different paint materials as required and can immerse inside and on the surface of the base band of the insulating paper; and the adhesive property of the insulating paint can be controlled through temperature. Three embodiments are listed as follows:

Embodiment 1: aramid paper is selected with a thickness of 0.05 mm, a width of 15 mm and a length of 5000 mm, and solvent-free epoxy paint is selected as the insulating paint. The insulating paint is firstly blended to appropriate viscosity; the aramid paper is dried; the processed aramid paper is immersed in the insulating paint, so the inside and the surface of the aramid paper are immersed with the insulating paint at the required content; and then the insulating paint and the aramid paper are solidified into an inseparable entirety at controlled temperature, or solidifying effect also can be achieved after standing for a period of time at room temperature; the insulating paper immersed in the paint is difficult to be etched by moisture at room temperature and is difficult to crack when wrapping a conductor.

Embodiment 2: NOMEX-410 paper is selected with a thickness of 0.05mm, a width of 18 mm and a length of 6000 mm, and solvent-free epoxy paint is selected as the insulating paint. The other operation methods are the same as that in embodiment 1.

Embodiment 3: NOMEX-410 paper is selected with the thickness of 0.05 mm, width of 18 mm and length of 6000 mm. Polyamide paint is selected as the insulating paint. Firstly, the NOMEX-410 paper is dried; and then the insulating paint is blended to appropriate viscosity to spray and coat on the NOMEX-410 paper; spraying can be repeated at least once in order to enable the inside and the surface of the NOMEX-410 paper to contain required insulating paint, so the insulating paint is uniformly distributed over the paper body.

The insulating paper subjected to the paint immersing processing can be directly covered and wound on the conductor in application; and then the conductor is wound as a transformer coil; the wound transformer coil is put into a drying furnace to dry; the temperature and time are set as required; after processing, the adhesive firmness between the insulating paper and the conductor as well as the adhesive firmness between the insulating paper are ensured after processing so as to reach the device meets requirements of electric property, mechanical property and insulating property.

The above embodiments are merely preferred embodiments of the invention; the invention is not limited to the structure of the above embodiments. Technical effects of the invention achieved via same means shall all fall within the protection scope of the invention.

What is claimed is:

1. A paint immersing process for insulating paper comprising:

a. blending insulating paint in a container to a predetermined viscosity, wherein the insulating paint is solvent-free epoxy paint;

b. drying the insulating paper, wherein the insulating paper is aramid paper;

c. entirely immersing the insulating paper into the insulating paint so an inside and a surface of the insulating paper are immersed with the insulating paint; and d. drying the insulating paper at a controlled temperature until solidifying the insulating paint and the insulating paper into an inseparable entirety, wherein the insulating paper is covered on the surface and also impregnated by the insulating paint;

e. covering and winding the solidified insulating paint and insulating paper on a conductor;

f. winding the conductor with the solidified paint and insulating paper into a transformer coil; and g. drying the wound transformer coil in drying furnace to ensure an adhesive firmness between the insulating paper and the conductor.

2. The process according to claim 1, wherein the insulating paper has a thickness of 0.05 mm.

3. The process according to claim 2, wherein the insulating paper has a width of 15 mm and a length of 5000 mm.

* * * * *